United States Patent [19]

Tomio

[11] 4,008,771

[45] Feb. 22, 1977

[54] TWO-WAY BULLDOZER MECHANISM

[75] Inventor: Uchida Tomio, Sagamihara, Japan

[73] Assignee: Caterpillar Mitsubishi Ltd., Tokyo, Japan

[22] Filed: July 30, 1975

[21] Appl. No.: 600,748

[30] Foreign Application Priority Data

Aug. 21, 1974 Japan ..... 49-95074

[52] U.S. Cl. ..... 172/806; 37/42 VL; 172/739; 172/802

[51] Int. Cl.² ..... E02F 3/76

[58] Field of Search ..... 172/703, 704, 734, 735, 172/736, 739, 777, 778, 801, 802, 803, 804, 805, 806, 807, 808, 809; 37/42 R, 42 VL

[56] References Cited

UNITED STATES PATENTS

| | | | |
|---|---|---|---|
| 2,657,481 | 11/1953 | Larsen | 37/42 VL |
| 3,199,234 | 8/1965 | Reissinger | 37/42 R |
| 3,853,181 | 12/1974 | Yoshizaki | 172/805 |

FOREIGN PATENTS OR APPLICATIONS

| | | | |
|---|---|---|---|
| 47-20503 | 6/1972 | Japan | 172/806 |
| 103,657 | 3/1964 | Norway | 172/806 |
| 224,377 | 11/1968 | U.S.S.R. | 172/802 |

*Primary Examiner*—Richard T. Stouffer
*Attorney, Agent, or Firm*—Frank L. Hart

[57] ABSTRACT

A two-way bulldozer mechanism for mounting on a forwardly extending push frame of an earthmoving vehicle is provided with a reversible blade assembly having opposite upper and lower blade portions hinged together by a central hinge connection formed therebetween. An elongated lever has a central pivot connection for pivotally mounting the lever to the push frame and a lower end thereof pivotally mounted to the blade assembly in coaxial relation to the hinge connection. A motor is operatively connected to the lever for pivoting such lever between a first angular position wherein the hinge connection is disposed rearwardly of the pivot connection and a second angular position wherein the hinge connection is forwardly thereof which, in cooperation with linkage mechanisms individually pivotally interconnecting each of the upper and lower blade portions to the push frame, is operative to position the blade portions in a predetermined pushing mode when the lever is in its first position and in an opposite pulling mode when the lever is in the second position.

10 Claims, 12 Drawing Figures

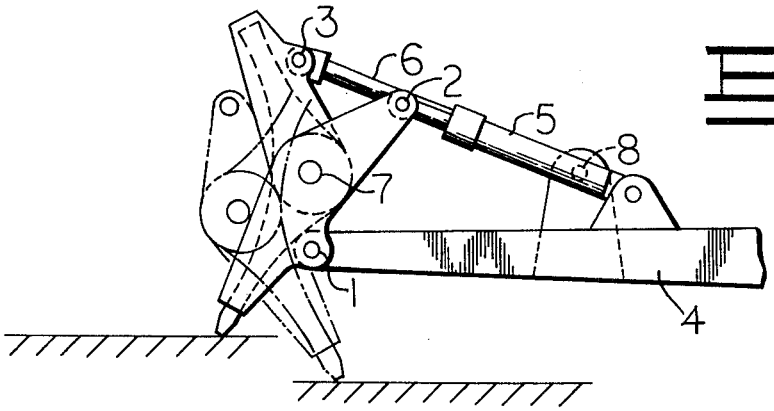
FIG. 1
PRIOR ART
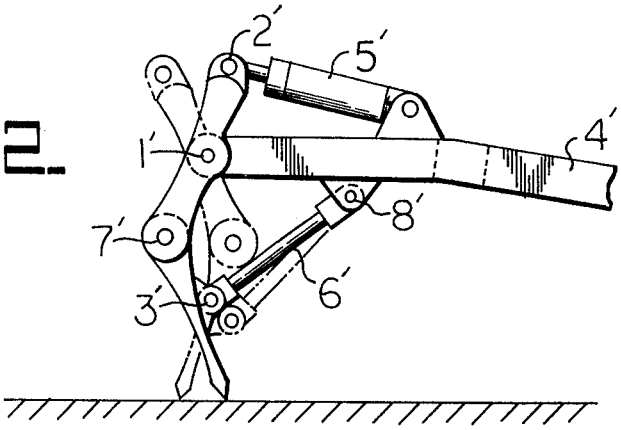
FIG. 2
PRIOR ART
FIG. 3A
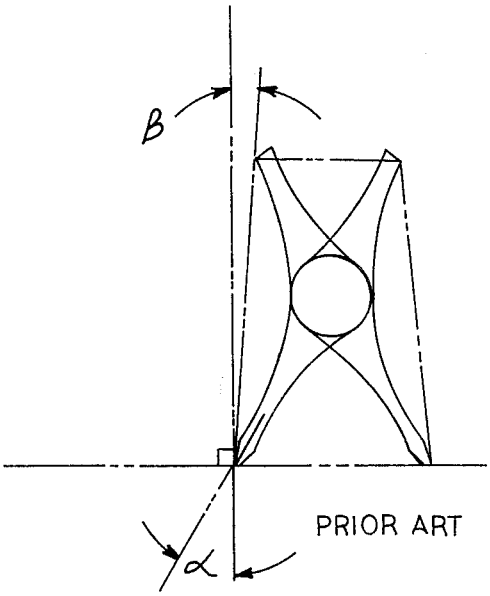
PRIOR ART
FIG. 3B
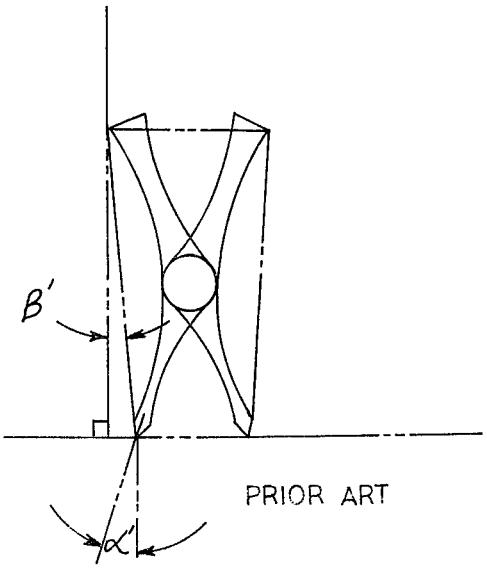
PRIOR ART 10
11
12
13
15
16
19
21
21A
22
26
27
29
30
31
32
33
34
35
36
38
39
40
40'
41
44
45
46
48
50
X
Y
h
V
V

TWO-WAY BULLDOZER MECHANISM

BACKGROUND OF THE INVENTION

1. Field of the Invention

This invention generally pertains to a bulldozer blade for an earthmoving vehicle, and more particularly, to a two-way bulldozer mechanism which is movable between a pushing mode and a pulling mode to permit bulldozing in both the forward and rearward directions of movement of the vehicle.

2. Description of the Prior Art

Two different prior art two-way bulldozer blade mechanisms which assume two operational modes are individually shown in FIGS. 1 and 2. For simplicity, only one side is shown and described in the following brief description of each mechanism.

FIG. 1 shows a two-way bulldozer blade mechanism which includes upper and lower blade portions hinged together by a hinge pin 7. The lower blade portion is pivotally connected to a push arm 4 by a pin 1 located below the hinge pin 7. The lower blade is provided with an upwardly extending lever arm portion for connecting such blade portion to a piston rod of an oil pressure cylinder 5 by means of a pin 2 located above the hinge pin 7. An upper brace 6 has one end thereof pivotally connected by a pin 8 to a bracket provided on a cross member between the push arms 4 and its other end pivotally connected by a pin 3 to the mid portion of the upper blade portion.

As a result, the upper and lower blade portions assume a pushing mode, as shown in solid lines in FIG. 1, when the piston rod of the cylinder 5 is retracted and a pulling mode, as shown in phantom lines, when the cylinder is extended. The mechanism of FIG. 1 advantageously allows the cutting angle of the lower blade and the curvatures of the moldboards of the blades to be set at desired values, as required. However, since the pin 1 is located substantially below the hinge pin 7, there results an insufficient elevational distance between the tip edge of the lower blade and the forward end of the push arm 4 so that in the pulling mode, the build up of material interfers with the push arm. This makes blade trimming difficult and hinders the piercing action of the lower blade.

FIG. 2 shows another two-way bulldozer blade mechanism wherein components thereof which are similar to those described in FIG. 1 are depicted by like numerals followed by a prime. In FIG. 2, the upper blade is pivotally connected to a push arm 4' at a pivot connection 1' at the center of the upper blade. A brace 6' has one end pivotally connected at 3' to the center of the lower blade portion and its other end pivotally connected at 8' to the under surface of the push arm 4'. The piston rod of a cylinder 5' is pivotally connected at 2' to the upper end of the upper blade. When the cylinder is retracted, the blades assume a pulling mode, as shown in the solid lines of FIG. 2, while when the cylinder is extended, the blades assume a pushing mode, as shown by the phantom lines. Thus, the arrangement of FIG. 2 is similar to an inversion of that of FIG. 1. The most outstanding feature of the mechanism of FIG. 2 is the increased distance provided thereby between the push arm 4' and the ground line which is achieved by positioning the pivot connection 1' above the hinge pin 7'. Thus, there is less interference between the push arm and the material to be removed by the blade mechanism in the pulling mode which reduces blade cutting edge piercing resistance and facilitates the trimming of the bulldozer blade.

However, many problems arise from the particular cutting angle of the lower blade, the curvatures of the moldboards, and the transmission of dozing forces through the mechanism of FIG. 2 to its push arms. In order to achieve maximum bulldozing efficiency, it is necessary that the upper and lower blades assume particular positions to provide a blade cutting angle and a material holding angle which fall within predetermined ranges. In this regard, the blade cutting angle is defined as the inclination of the lower blade to a vertical line normal to the surface of the ground which is designated by the Greek letter $\alpha$ in FIG. 3A, while the material holding angle is defined as the angle formed between a line connecting the tips of the upper and lower blade and such vertical line which is designated by the Greek letter $\beta$. The ideal range for the blade cutting angle is generally between 35° and 38°, while the range of the material holding angle is generally between 8° and 13°.

FIG. 3A is a diagrammatical illustration of the blade mechanism of FIG. 1 which provides a blade cutting angle $\alpha$ and a material holding angle $\beta$ which are within such ideal ranges, while FIG. 3B is illustrative of the blade mechanism of FIG. 2 and shows a cutting angle $\alpha'$ which is approximately one-half of the desired cutting angle of FIG. 3A and a material holding angle $\beta'$ which is inclined in a direction opposite to that shown in FIG. 3A.

Consequently, the blade mechanism of FIG. 2 offers greater digging resistance due to its reduction in the blade cutting angle so that a greater pushing or towing force must be provided by the tractor on which the blade is mounted. The oppositely inclined material holding angle $\beta'$ will cause the material being removed by the blade to drop before reaching the tip of the upper blade. Therefore, the aforesaid cutting angle and material holding angle are not preferable from the viewpoint of the efficient utilization of the tractive force of the tractor and bulldozing efficiency.

To cope with these problems, there may be proposed an attempt in which the configuration of the phantom trapezoid shape of the diagram of FIG. 3B is brought closer to that of the diagram of FIG. 3A by improving the relationship between the pins 3' and 7', the pins 1' and 7' or by changing the stroke of the piston rod of the cylinder 5', for achieving the desired cutting angle. However, the results in a further inverse inclination of the material holding angle so that the pin 1' connecting the upper blade to the push arm 4' should be positioned at the uppermost end of the upper blade or thereabove, while the position of the pin 2' relative to the pin 1' should be raised further upwards. As a result, even if the length of the arm for mounting the cylinder 5' at pin 2' is extended longer, there may not be achieved a desired configuration of the blades which are well adapted for the practical application.

In addition, there is another disadvantage, in that since the upper and lower blades are hinged by the hinge pin 7' and the upper blade is connected to the piston rod of the cylinder, the digging loads will be transmitted by way of the lower blade, pin 7', the upper blade, and the cylinder 5' to the push frame so that reasonable rigidity will be required for such members. In this respect, the arrangement of FIG. 1 is superior to that of FIG. 2 in that the loads thereof are transmitted solely by way of the lower blade and the cylinder 5, thus bypassing the hinge pin 7 and the upper blade.

OBJECTS OF THE INVENTION

Accordingly, an object of this invention is to provide an improved two-way bulldozer mechanism which is effective in overcoming the above problems of the prior art by providing an ideal cutting angle and material holding angle for the blades in both the pushing and pulling modes of operation to increase bulldozing efficiency and also to provide sufficient clearance between the push frame and the ground to minimize its interference with the material being removed by the blade mechanism in the pulling mode of operation.

Another object of this invention is to provide a two-way bulldozer mechanism which alleviates the jamming of material between the cylinder and the push frame by having the cylinder move away from the push frame when the blade mechanism is changed from its pulling mode to its pushing mode.

Another object of this invention is to alleviate the exertion of any undue bulldozing loads or impact loads caused by dropping of the blade mechanism to the adjustment cylinders of such mechanism in both the pulling and pushing modes of operation by providing stopper means on the push frame which are engageable with the blade mechanism to transfer such loads directly to the push frame.

These and other objects and advantages of the present invention will become more readily apparent upon reference to the accompanying drawings and following description.

BRIEF DESCRIPTION OF THE DRAWINGS

FIGS. 1 and 2 are side elevational views of two different prior art two-way bulldozer blade mechanisms.

FIGS. 3A and 3B are schematic diagrams showing the blade mechanisms of FIGS. 1 and 2, respectively.

DESCRIPTION OF THE PREFERRED EMBODIMENT

Figure 4:
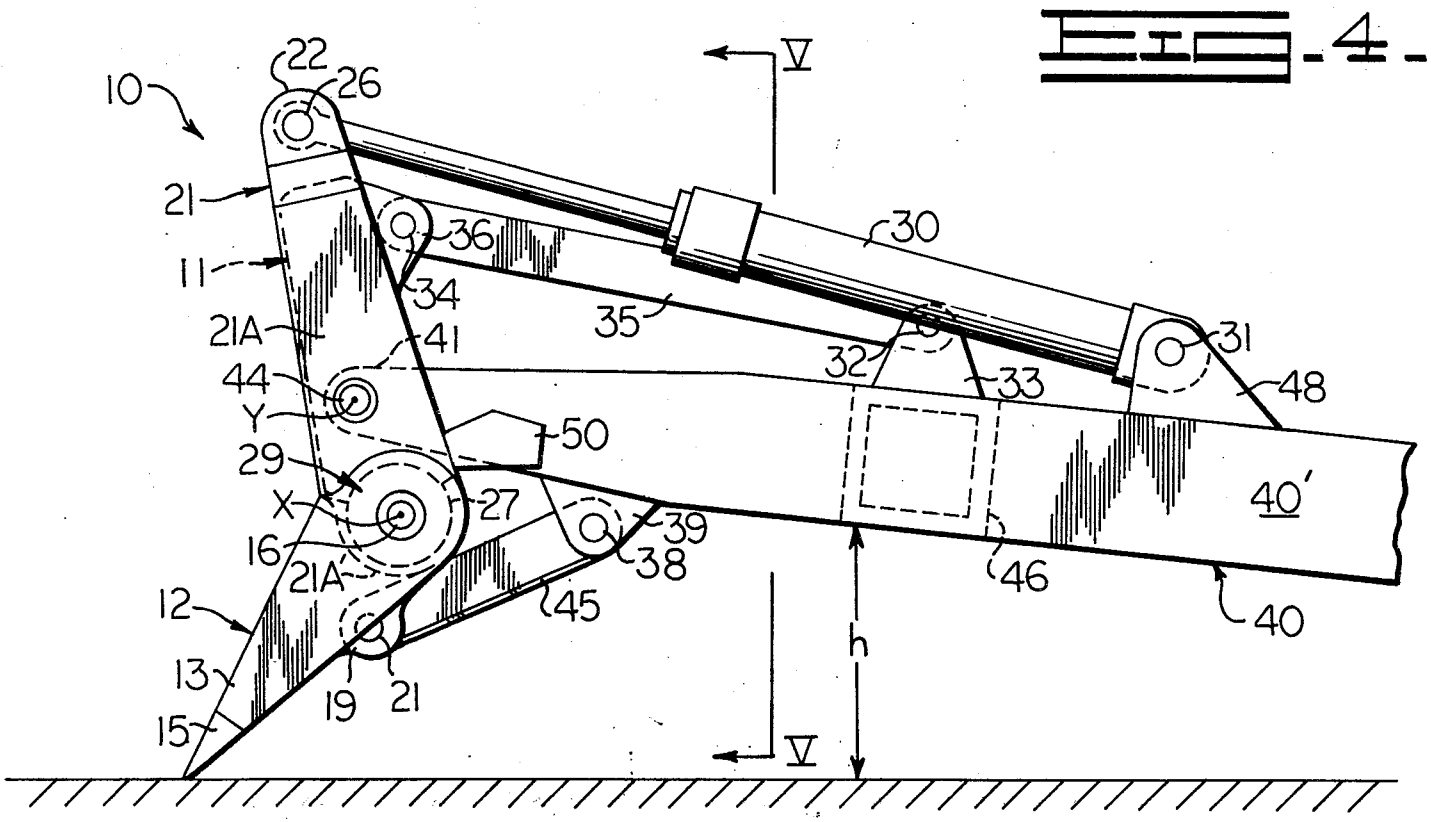
FIG. 4 is a side elevational view of a two-way bulldozer mechanism embodying the principles of the present invention shown in its pushing mode of operation.

Referring now to FIGS. 4 through 8, a two-way bulldozer mechanism embodying the principles of the present invention is generally indicated at 10 for mounting at the front end of an earthmoving vehicle, not shown. In general, the bulldozer mechanism 10 includes upper and lower blades 11 and 12; a hinge connection 29 pivotally connecting such blades together; blade supporting means, such as a pair of laterally spaced, forwardly extending push arms 40; a pair of upper control links 35; a pair of lower control links 45; and actuator means, such as a pair of levers 21 and a pair of extensible and retractable jacks or oil pressure cylinders 30.

Figure 7:
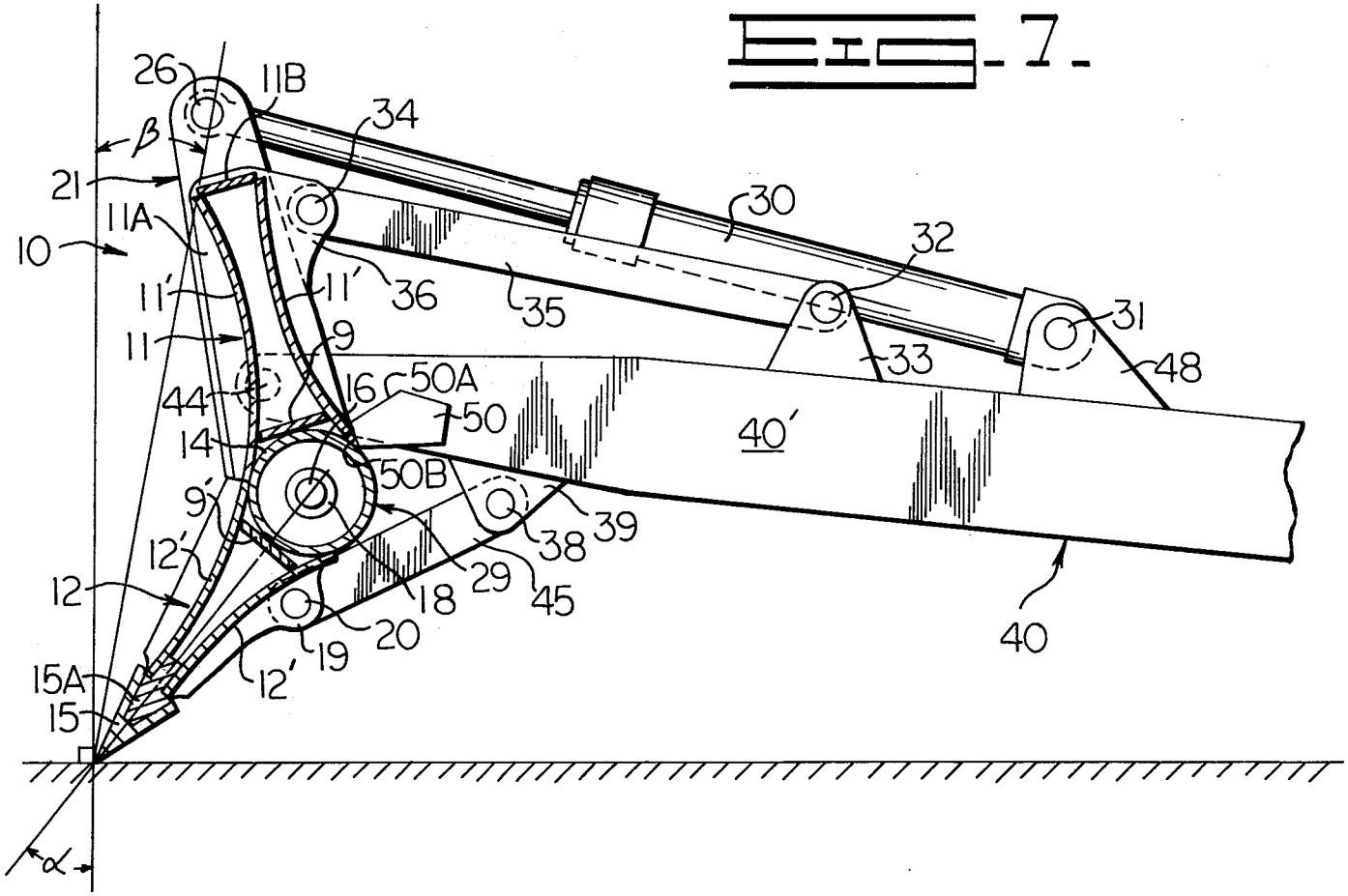
FIG. 7 is a cross sectional view taken along the line VII—VII of FIG. 5 showing the bulldozer mechanism in its pushing mode position.

As best shown in FIG. 7, the upper blade 11 is constructed from a pair of opposite forwardly and rearwardly facing moldboards 11', 11' which extend between a pair of laterally spaced side boards 11A. A top plate 11B is secured across the upper ends of the moldboards 11', 11' and a reinforcing plate 9 is secured between such moldboards adjacent their lower ends.

The lower blade 12 is similarly constructed from a pair of oppositely facing moldboards 12', 12'. The lower blade 12 is made somewhat longer than the upper blade 11 by extending the forward moldboard 12' laterally beyond the upper blade side boards 11A between a pair of outer side boards 13. The rearward moldboard 12' extends between a pair of inner side boards 12A which are disposed in alignment with the side boards 11A of the upper blade 11. A pair of second rearward moldboards 12'', as best shown in FIGS. 5 and 6, are connected between the inner side boards 12A and the outer side boards 13 to make the width of the rearward moldboard of the lower blade the same as its forward moldboard.

Figure 8:
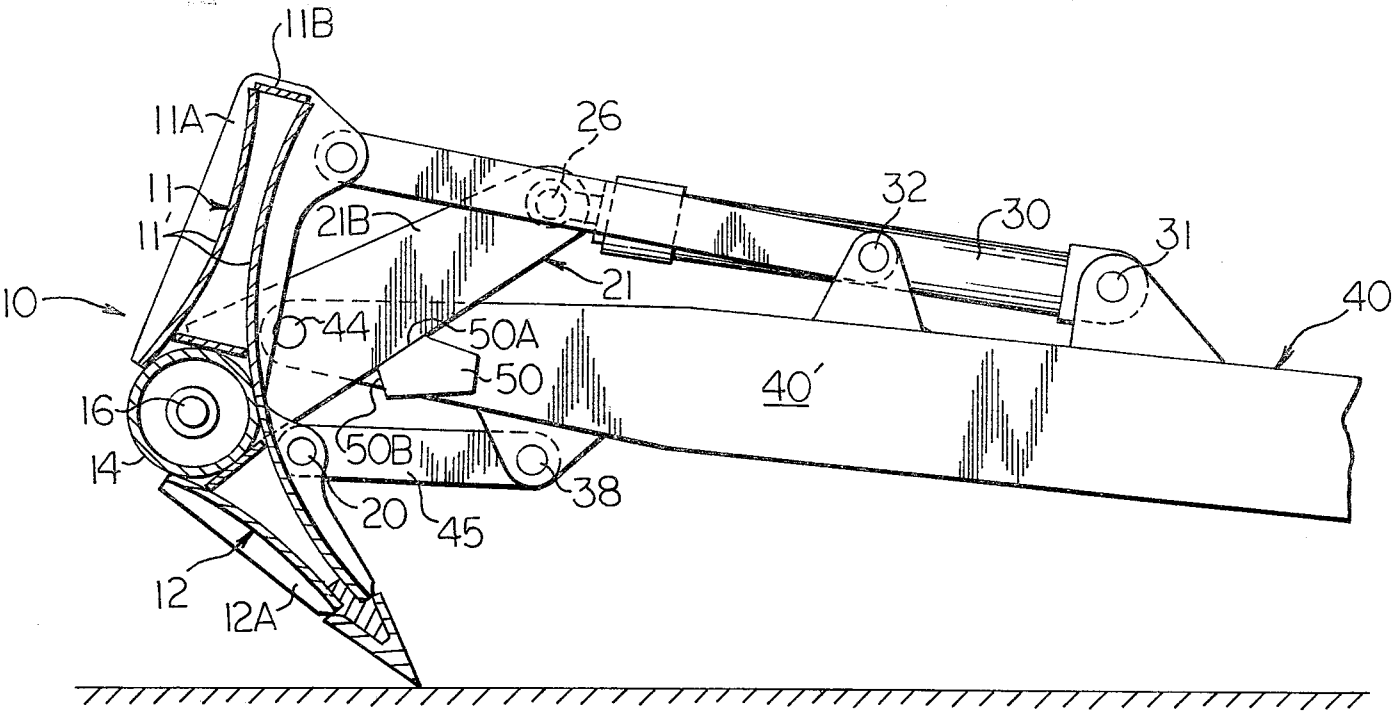
FIG. 8 is a cross sectional view similar to FIG. 7, but showing such mechanism in its pulling mode position.

Interposed between the lower ends of the lower moldboards is a reinforcing member 15A (FIG. 7) to which a cutting edge 15 is removably secured by bolts or other means, not shown. A reinforcing plate 9' is secured between the lower moldboards adjacent their upper ends. Each of the moldboards 11', 11' and 12', 12' and 12'' are suitably curved so as to provide a continuous arcuate blade surface when the blade mechanism is in either its pushing mode, as shown in FIG. 7, or its pulling mode, as shown in FIG. 8.

Figure 5:
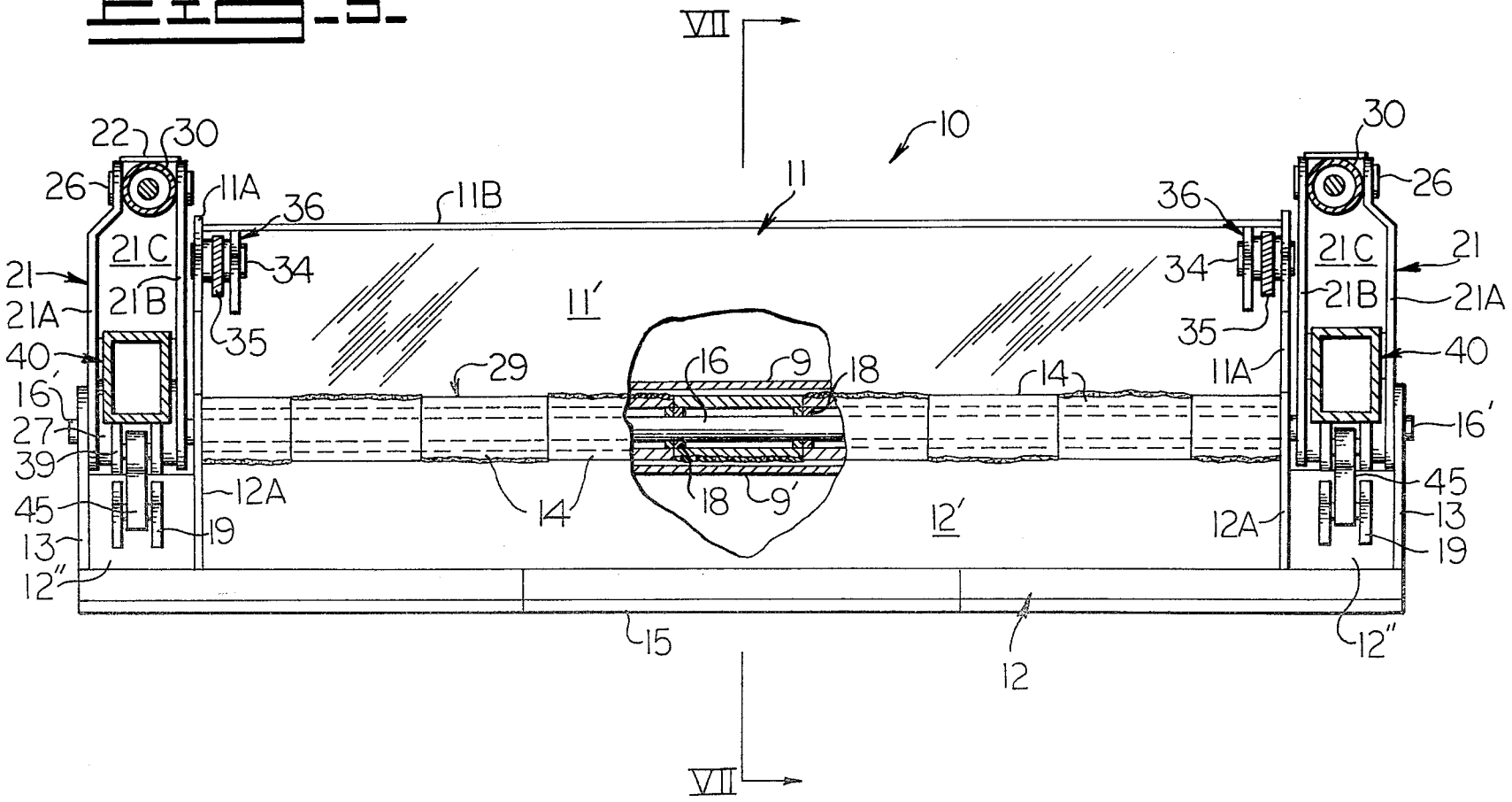
FIG. 5 is a cross sectional view of such mechanism taken along the line V—V of FIG. 4.

As best shown in FIG. 5, the hinge connection 29 for pivotally connecting the upper and lower blades, 11 and 12, together includes a plurality of shortly cut cylinder or pipe members 14 which extend along the length of the blades between their reinforcing blades 9, 9', with alternate ones thereof being secured, such as by welding, to the adjacent edges of the respective moldboards of the upper and lower blades. A pair of annular pin bosses 18 are secured at the opposite ends of each of the pipe members 14, as best shown in the broken away center portion of FIG. 5, for receiving an elongated hinge pin 16 therethrough.

Figure 6:
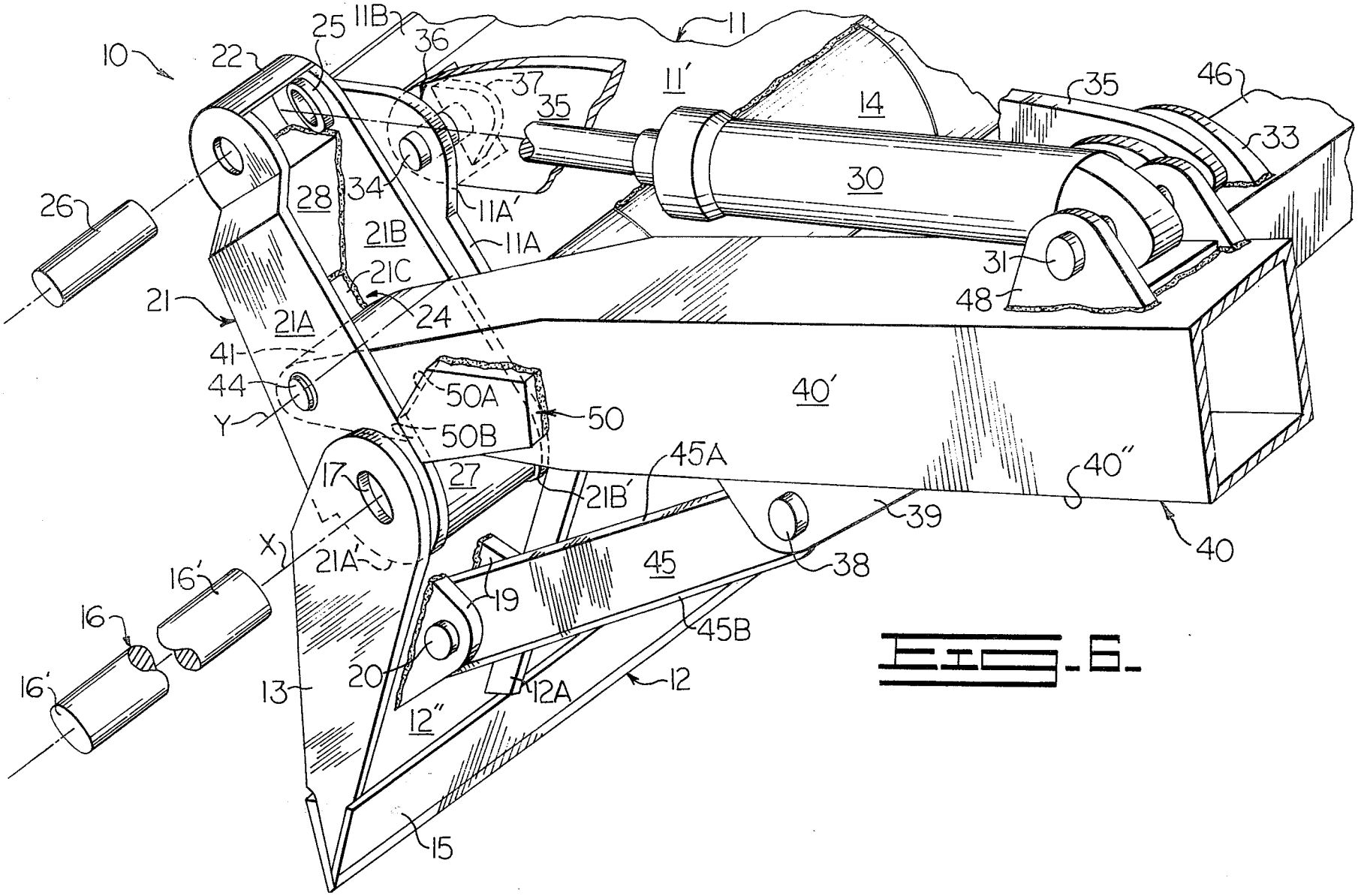
FIG. 6 is a fragmentary perspective rear elevational view of the bulldozer mechanism of FIG. 1 and illustrating the construction of a lever and its associated members therefor.

The levers 21, one of which is shown in FIG. 6, have a box-type construction including a pair of laterally spaced side boards 21A and 21B and a front board 21C extending between the forward edges of the side boards. The front board 21C has a curved upper end portion 22 extending over the top edges of the side boards 21A and 21B. The side boards have lower circular end regions 21A' and 21B', respectively, for mounting a cylindrical member 27 therebetween. The lower circular end regions 21A' and 21B' are spaced for receipt between the upper ends of the inner side board 12A and the outer side board 13 of the lower blade 12. A pin inserting hole 17 is formed through such members for receiving the opposite ends 16' of the hinge pin 16 which protrude beyond the ends of the upper blade 11, thus pivotally mounting the lever to the lower blade in coaxial alignment with the hinge connection 29 which together define a first axis X. The lever 21 is open rearwardly defining a space 24 between the inner and outer side boards 21A and 21B, respectively. A reinforcing rib 28 is secured, such as by welding, between the sideboards adjacent their upper ends for reinforcement purposes.

The push arms 40 have forward tip portions 41 which are individually received within the spaces 24 of the levers 21. The levers 21 are pivotally mounted to the forward tip portions of their respective push arms 40 by a pivot pin 44 which is disposed a predetermined elevational distance above the hinge connection 29 and defines a second axis Y which is disposed parallel to the axis X.

The pair of upper braces or links 35 each have one end thereof pivotally mounted by a pin 34 to a bifurcated bracket 36 carried at the upper end of the upper blade 11. Each bracket 36 is preferably formed by a rearwardly projecting flange 11A' formed on each of the side boards 11A and an inwardly spaced projecting piece or flange 37 secured to the rearward moldboard 11', as best shown in FIG. 6. The opposite end of each link 35 is pivotally connected by a pin 32 to a bifurcated bracket 33 carried on a cross member 46 interconnected between the push arms 40.

The pair of lower braces or links 45 each have one end thereof pivotally connected by a pin 20 disposed below pin 16 to a bifurcated bracket 19 carried on the second rear moldboards 12'' of the lower blade 12. The opposite end of each link 45 is pivotally connected by a pin 38 to a bifurcated bracket 39 mounted on the lower surface 40'' of the push arms 40.

The cylindrical member 27 is preferably sized somewhat smaller than the pipe members 14 so as to prevent its abutment with an upper edge 45A of the lower brace 45 during the pivotal movement of the lower blade to be described later. A knife edge 45B is provided along the lower edge of the brace 45 so as to facilitate the piercing of such brace into the material to be removed by the blade mechanism in operation.

The jacks 30 have their head ends pivotally mounted by pins 31 to bifurcated brackets 48 provided on the upper surface of the push arms 40. The rod ends of the respective jacks are journalled on pivot pins 26 mounted at the upper ends of the levers 21. In particular, the pin 26 transverses each of the side boards 21A and 21B of each of the levers, each of which includes an annular pin boss, one of which is shown at 25 in FIG. 6, for reinforcement purposes.

The two-way bulldozer mechanism 10 also includes stopper means or blocks 50 which are individually secured on the opposite side surfaces 40' of each of the push arms 40. Each block is provided with a pair of angularly disposed edges or faces 50A and 50B which are positioned so that the faces 50B are disposed in abutting engagement with the longitudinal edges of the corresponding side boards 21A, 21B of the levers 21 when such levers are pivoted forwardly by the jacks 30, as shown in FIG. 7, and the faces 50A engage such edges of the side boards when the levers are pivoted rearwardly, as shown in FIG. 8.

OPERATION OF THE PREFERRED EMBODIMENT

While the operation of the present invention is believed clearly apparent from the foregoing description, further amplification will be made in the following brief summary of such operation. In operation as will become more readily apparent, the particular construction of the present bulldozer mechanism 10 is capable of positioning its upper and lower blades 11 and 12 in either a forward pushing mode, as shown in FIG. 7, for when the tractor moves in a forward direction or a reverse pulling mode, shown in FIG. 8, for when the tractor moves in a rearward direction. In the pushing mode of FIG. 7, the lower blade is disposed at a predetermined cutting angle $\alpha$ and the upper blade 11 is disposed in predetermined angular relationship thereto to provide a predetermined material holding angle $\beta$. Such cutting and material holding angles are disposed within the desired ranges mentioned previously so as to enhance bulldozing efficiency. In the reverse pulling mode, the relative position of the upper and lower blades are substantially reversed so that the proper cutting and material holding angles are also provided in such reverse pulling mode.

The positioning of the bulldozer mechanism in its pushing mode is effected by the extension of the jacks 30 which rotate the levers 21 in a counterclockwise direction, as viewed in FIG. 4, about the second axis Y or pins 44 mounting the levers to the respective forward tips 41 of the push arms 40. This causes the hinge connection 29 or the first axis X to move in an arcuate path below the axis Y to a rearward most position, as depicted in FIGS. 4 and 7. As this occurs, the upper blade also pivots about the pin 34 of the upper link 35 which causes the upper blade 11 to tilt forwardly, while the lower blade is caused to tilt rearwardly due to the effect of the lower control link 45. Such movement of the upper and lower blades occurs until the respective side boards 21B and 21C of the levers 21 are brought into abutting engagement with the faces 50B of the stoppers 50, thus limiting further pivotal movement of the levers.

Conversely, the positioning of the blades 11 and 12 to their respective pulling positions is effected by the retraction of the jacks 30. This rotates the levers 21 in a clockwise direction so as to position the first axis X forwardly of the second axis Y which causes the upper blade portion to tilt rearwardly due to the upper link 35 and the lower blade 12 to tilt forwardly due to link 45. Thus, the blade mechanism 10 of the present invention is effective in providing a cutting angle and an operational curvature which are suited for removing material during both forward and rearward movements of the vehicle.

According to the present invention, the pivot pins 44 for connecting the lever means 21 to the push arms 40 are positioned upwardly of the hinge connection 29 so that the push arms and its cross member 46 are positioned at a proper height *h*, as shown in FIG. 4, so as to minimize the interference of the push arm with material being removed in the pulling mode of operation.

The jacks 30 are also advantageously disposed in their retracted position when the blade mechanism is in its pulling mode so that the cylinder rods of such jacks are not exposed to material being upheaved by the blade mechanism during a pulling operational mode, thus alleviating any possible damage thereto. Injury to the jacks is also alleviated due to the fact that the jacks pivot about their pins 31 in a direction away from the push arms when the blade mechanism is changed from its pulling mode to its pushing mode so as to eliminate any possible nut-cracker effect with any material upheaved on top of the push arms during such pulling operation.

Because the levers 21 are provided independently of the upper blade 11, it is possible through the use of the appropriate upper links 35 to properly position the upper blade relative to the lower blade 12 to provide the ideal material holding angle in both of the blade operating modes, as well as to position the upper moldboards a desired position relative to the lower moldboards to provide a continuous blade curvature to the bulldozer mechanism in either mode.

The stoppers 50 are provided for transferring bulldozing loads exerted on the levers 21 through the lower blade in either operating mode directly into the push arms 40 so as to relieve such loads from the jacks 30. Such stoppers are also effective in relieving the jacks of impact loads in the event the blade mechanism is dropped from its maximum height to the ground.

DESCRIPTION OF THE ALTERNATE EMBODIMENTS

Figure 9:
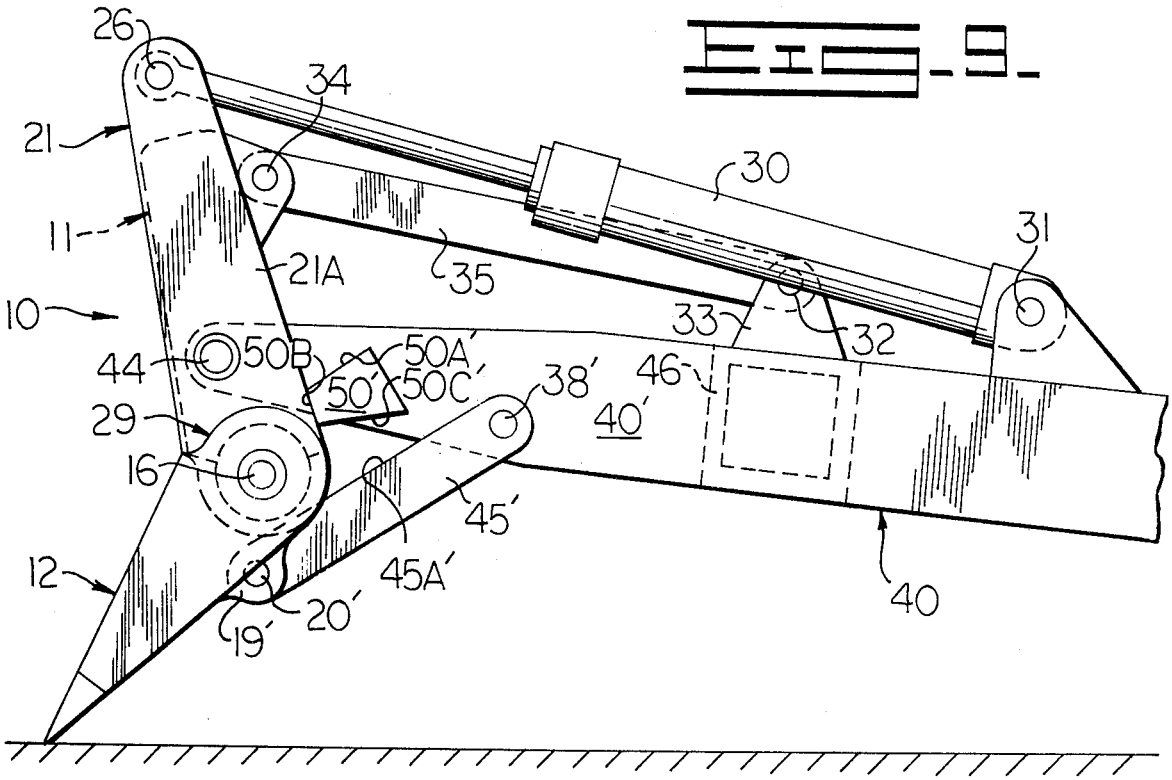
FIGS. 9 and 10 are side elevational views of a modification of the present invention showing and alternate form of a blade stopper therefor and an alternate method of mounting the lower links to a push frame for mounting such mechanism.
Figure 10:
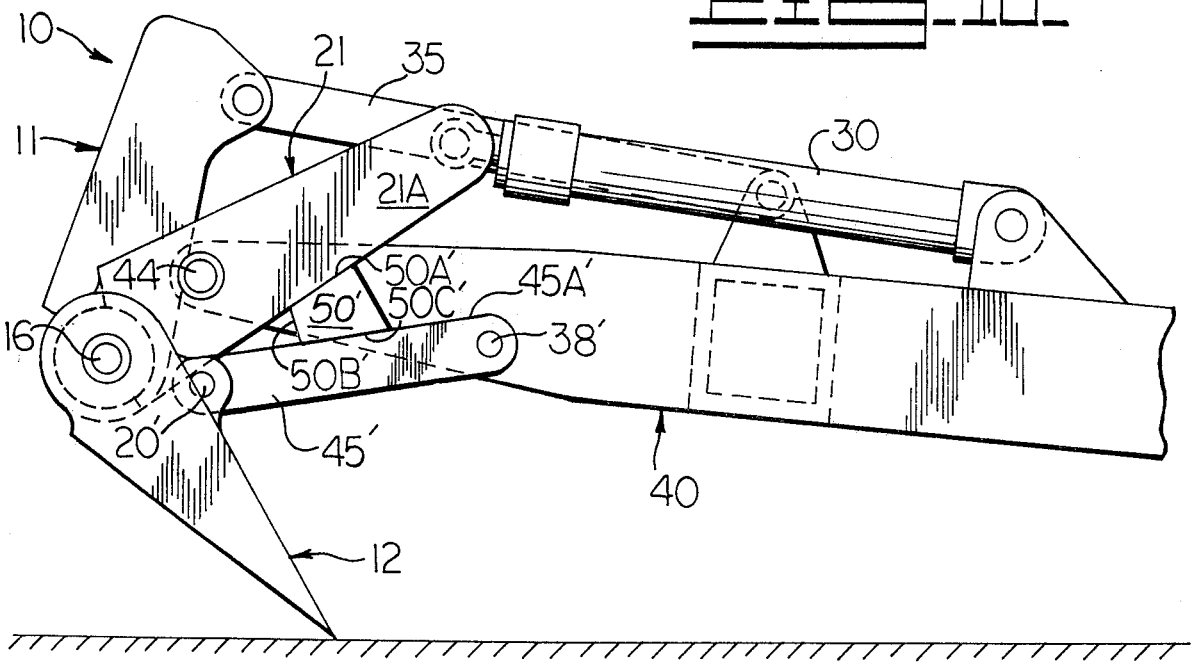

An alternate embodiment of the present invention is illustrated in FIGS. 9 and 10 which is substantially identical to the preceding embodiment, except for the following distinctions.

The first distinction includes the use of two pairs of lower braces or links 45' which, while being similar to the single pair of links 45 of the preceding embodiment, are mounted in a somewhat different manner therefrom. The links 45' are individually mounted on the opposite sides 40' of each of the push arms 40 by pins 38'. The other ends of such links are pivotally mounted by pins 20' to a pair of aligned brackets, one of which is shown at 19', carried on the lower blade 12.

Another difference of this embodiment is in the construction of the stoppers 50' which includes an upper edge or face 50A', a forward edge or face 50B', and a lower edge or face 50C'. The upper faces 50A' are disposed for impingement against the respective longitudinal edges of the side boards 21A and 21B of the levers 21 when in its pulling attitude (FIG. 10), whereas the forward faces 50B' are disposed for impingement against such edges when the lever is in its pushing attitude (FIG. 9.), as in the preceding embodiment. However, in this embodiment, the lower faces 50C' are positioned for impingement against the upper edges 45A' of respective ones of the lower links 45' when the blade is in its pulling mode, as shown in FIG. 10. The additional support provided by the lower faces 50C' when the blade is in the pulling attitude provides additional protection for the jacks 30 to prevent possible damage due to impact loads in the event the blade is quickly dropped or the like. Thus, the second embodiment provides an additional advantage not found in the preceding embodiment.

Figure 11:
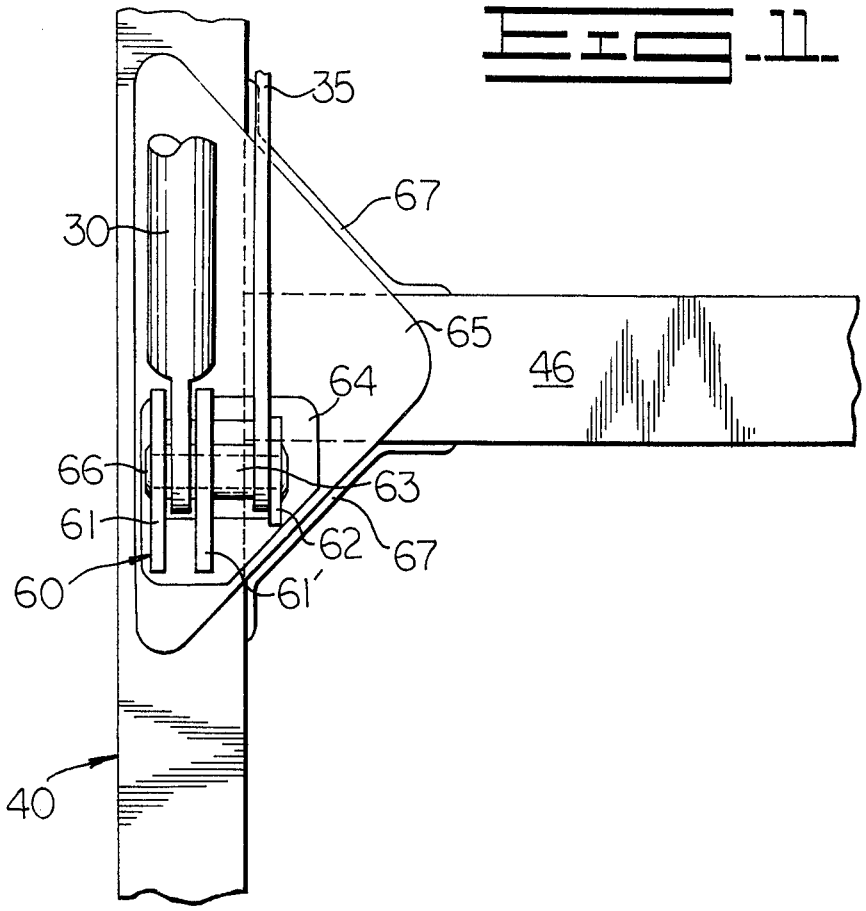
FIG. 11 is a plan view of a modification of the present invention showing an alternate method of mounting the jacks and upper links to the push frame.

A third modification of the present invention includes a pair of dual type mounting brackets, one of which is illustrated at 60 in FIG. 11, for providing an alternate method of mounting the head ends of the jacks 30 and the upper links 35 to their respective push arms 40. Each mounting bracket 60 includes a triangular base plate 65 secured, such as by welding, atop the push arm 40 and the adjacent end of the cross member 46. Such base plate also serves as a rib for strengthening the connection between the push arm and the cross member and is preferably provided with a pair of side plates 67 which are angularly disposed between the adjoining side of the push arm and cross member along the respective edges of the triangular base plate for providing additional rigidity to the frame structure.

The bracket 60 also includes a small reinforcing plate 64 which is welded atop the base plate 65 upon which three upstanding, laterally spaced bracket plates 61, 61' and 62 are secured. A pivot pin 66 is disposed through such bracket plates for pivotally mounting the head end of the jack 30 between plates 61, 61' and the adjacent end of the link 35 between plates 61' and 62 so that the jack and lever are mounted to the push arms in coaxial relation to each other. A pin boss or spacer 63 is provided about the pin between the plate 61' and the link 35 for providing the necessary lateral clearance between the jack and the link to prevent their interference during operation. The dual type bracket 60 is particularly useful for attaching a guard panel, not shown, to the braces 35 for protecting the upper surfaces of the jacks 30.

It will be appreciated that the alternate embodiment shown in FIGS. 9 and 10 and the modification of FIG. 11 operate in essentially the same manner as that described for the preferred embodiment and provide the same results thereas with the exception of the configuration of the stopper members 50' of FIGS. 9 and 10 which cooperates with the lower links 45' to provide additional support for preventing damage to the jacks 30.

While the invention has been described and shown with particular reference to the preferred embodiments, it will be apparent that variations might be possible that would fall within the scope of the present invention which is not intended to be limited except as defined in the following claims.

What is claimed is:

1. A two-way bulldozer mechanism comprising:

an upper blade and a lower blade hinged to each other by a hinge pin for pivotal movement about a first axis thereat;

a pair of lever means journalled on the opposite ends of said hinge pin;

a pair of push arms to which said pair of lever means are individually pivotally connected for rotation about a second axis;

a pair of oil pressure cylinders, each having one end pivotally connected to respected ones of said push arms, and having their opposite ends pivotally connected to respective ones of said lever means;

a pair of first supporting means, each having one end thereof pivotally connected to said push arms and their opposite ends pivotally connected to said lower blade; and a pair of second supporting means, each having one end pivotally connected to said push arms and their opposite ends pivotally connected to said upper blade;

whereby said pair of lever means effect the pivotal movement due to the extension and retraction of said oil pressure cylinders so that said first axis is rotated in an arc about said second axis, and thereby said upper and lower blades assume pushing and pulling modes, with the aid of linkage of said first and second supporting means.

2. A two-way bulldozer mechanism as set forth in claim 1, wherein said first hinge points are located above said second hinge points; said first and second supporting means are located on the vertically opposite sides of said first hinge points, respectively; and bracket means are provided on the top ends of said lever means, respectively, for providing said hinge joints between said piston rods and said lever means.

3. A two-way bulldozer mechanism as set forth in claim 1, wherein a pair of stopper means are provided on the outer side surfaces of said pair of push arms, respectively; whereby when said pair of lever means assume either a pushing attitude or a pulling attitude due to the respective extension and retraction of said oil pressure cylinders, the side edges of said lever means abut said pair of stopper means, respectively, so that a considerable part of any impact load imposed on said upper and lower blades is transmitted through said stopper means to said push arms to prevent the propagation of adverse impact to said oil pressure cylinders.

4. A two-way bulldozer mechanism as set forth in claim 1, wherein each of said upper and lower blades includes a plurality of spaced short cylinder members secured thereto, with the cylinder members of one blade being intermeshed with the cylinder members of the other blade when assembled; and at least one pin piercing through said cylinder members being meshed with each other; said lever means being journalled on the opposite end portions of said pin which are exposed from said cylinder members; and said cylinder members being secured to the edges of moldboards forming said upper and lower blades, respectively, thereby enabling said upper and lower blades to effect pivotal movement about said first axis.

5. A two-way bulldozer mechanism mounted on a forwardly extending push frame of an earthmoving vehicle, said push frame having a pair of laterally spaced push arms, said bulldozer mechanism comprising:

a reversible blade assembly having an upper blade portion, a lower blade portion and a central hinge connection pivotally connecting such blade portions together to permit their relative angular adjustment about said hinge connection;

elongated lever means having opposite ends and a central pivot connection spaced intermediate said ends for pivotally mounting said lever means to said push frame;

means pivotally mounting one end of said lever means to said blade assembly in coaxial relation to said hinge connection so that said hinge connection is movable in an arcuate path about the central pivot connection of said lever means;

motor means operatively connected for pivoting said lever means about its pivot connection between a first angular position wherein said hinge connection is disposed rearwardly of said pivot connection and a second position wherein said hinge connection is forwardly thereof; and linkage means pivotally interconnected between said blade assembly and said frame for individually positioning said upper and lower blade portions thereof in a predetermined pushing mode when said lever means is in its first position and in an opposite pulling mode when said lever means is in its second position, said linkage means including a pair of upper links individually interconnected between respective ones of said push arms and said upper blade portion, and a pair of lower links individually interconnected between such push arms and said lower blade portion.

6. The bulldozer mechanism of claim 5 wherein said pivot connection of said lever means is also disposed elevationally above said hinge connection when said lever means is in its second position so that said push frame is positionable sufficiently high off the ground to minimize its interference with material being removed by the bulldozer mechanism during rearward operation of the vehicle in the pulling mode.

7. The bulldozer mechanism of claim 6 wherein said linkage means is effective in positioning said upper and lower blade portions in predetermined angular relationships relative to each other and to the ground so as to provide the blade mechanism with an ideal blade cutting angle and material holding angle in both the pushing and pulling modes to obtain optimum bulldozing efficiency.

8. The bulldozer mechanism of claim 7 in which each of said push arms has a forward end and wherein;

said lever means includes a pair of generally upright levers, each lever having opposite upper and lower ends and a central pivot connection, with said central pivot connections being connected to the forward ends of respective ones of said push arms; and said hinge connection includes an elongated hinge pin having opposite ends protruding from the opposite sides of said upper blade portion upon which opposite ends the lower ends of said levers are journalled.

9. The mechanism of claim 8 wherein said motor means includes a pair of extensible and retractable jacks, with each jack being pivotally connected between the upper end of respective ones of said levers and said push arms for pivoting said levers about their central pivot connections to their first position upon the extension of said jacks and to their second positions upon the retraction of said jacks.

10. The bulldozer mechanism of claim 9 including stopper means individually carried by said push arms and positioned for abutting engagement with said levers for limiting the pivotal movement of said levers beyond their first and second positions and for transmitting any loads tending to pivot such levers beyond said first and second positions directly into said push arms so as to relieve the exertion of said loads on the jacks.

* * * * *